United States Patent [19]

Kjaer

[11] 4,300,707

[45] Nov. 17, 1981

[54] COMBINED RUCKSACK FRAME AND CHAIR

[76] Inventor: Per Kjaer, Nedre Skogvei 4B, Oslo 2, Norway

[21] Appl. No.: 69,304

[22] Filed: Aug. 24, 1979

[30] Foreign Application Priority Data

Aug. 25, 1978 [NO] Norway ..... 782887

[51] Int. Cl.[3] ..... A45F 4/02

[52] U.S. Cl. ..... 224/155; 297/129

[58] Field of Search ..... 224/154, 155, 264; 297/16, 31, 34, 46, 55, 59, 129

[56] References Cited

U.S. PATENT DOCUMENTS

| | | | |
|---|---|---|---|
| 2,973,888 | 3/1961 | Beardsley | 224/155 |
| 3,315,856 | 4/1967 | Black | 224/155 |
| 3,885,722 | 5/1975 | Robertson | 224/264 X |
| 4,044,931 | 8/1977 | Catelli | 224/155 |

FOREIGN PATENT DOCUMENTS

| | | | |
|---|---|---|---|
| 86796 | 2/1956 | Norway | 224/155 |
| 379072 | 8/1964 | Switzerland . | |

*Primary Examiner*—Stephen Marcus
*Attorney, Agent, or Firm*—Fleit & Jacobson

[57] ABSTRACT

There is provided a device which may be used as a rucksack frame in a first functional position and as a chair with a backrest in a second functional position. The device comprises a first and a second frame member with mutually parallel side parts of which the side parts of the first frame member have end portions which are hingedly connected to respective side parts of the second frame member at a distance from the ends of the latter frame member so that the side parts of the frame members may be disposed parallel with and at right angles to each other, respectively. At the end opposite to the articulated end portions the first frame member has a support portion projecting from the side parts a distance essentially corresponding to the distance between the hinge connections and the outer end of an end support portion of the second frame member, the support portions cooperating as chair supports in said second functional position of the device.

7 Claims, 3 Drawing Figures

COMBINED RUCKSACK FRAME AND CHAIR

The present invention relates to a device of the type which, in a first functional position, may be used as a rucksack frame and in a second functional position may be used as a chair with a backrest, the device being made up of articulated rod or tube members.

Such a device is e.g. known from Swiss Pat. No. 379,072. This known device consists of a rack constituted by four separate tubular members, more specifically a U-shaped seating frame, a pair of leg pair stirrups foldable against the seating frame, and a backrest stirrup which are also foldable against the seating frame. The several elements which are thus included in the device, result in an unfavourable and undesirable increase of weight, and further in that the device does not become so simple and cheap to manufacture and so attractive to use as desirable.

The object of the present invention is to provide a device of said type which comprises a minimum number of parts and which is thus light of weight, and which is simple to manufacture and further allows easy adjustment, for example from use as a rucksack frame to use as a chair.

According to the invention the device comprises a first and a second frame member with mutually parallel side parts of which the side parts of said first frame member have end portions which are articulated by hinge connections to respective side parts of the second frame member at a distance from the ends thereof, whereby the side parts of said frame members are capable of being disposed parallel to and at right angles to each other, respectively, said first frame member, at the end opposite to said articulated end portions, having a support portion projecting from the side parts a distance essentially corresponding to the distance between said hinge connections and the outer end of an end support portion of said second frame member, and wherein the frame members are provided with supporting bands stretched between the side parts of each frame member.

In an advantageous embodiment of the invention which enables a very simple manufacturing, each frame member consists of an essentially U-shaped stirrup having a pair of legs and a web portion, the legs of said stirrups constituting said side parts of the frame members and the web portions of said stirrups constituting said support portions.

Figure 1:
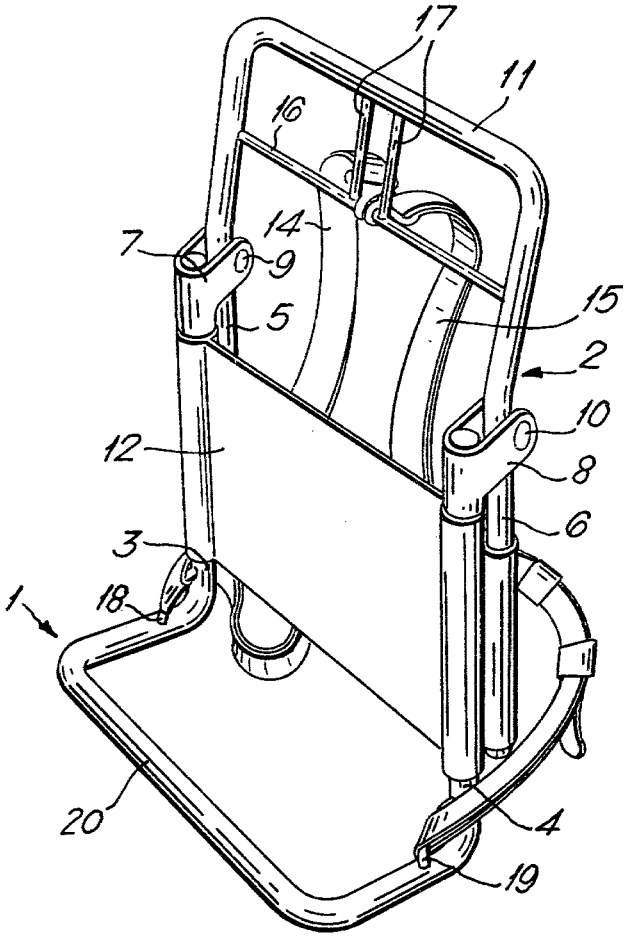
Figure 2:
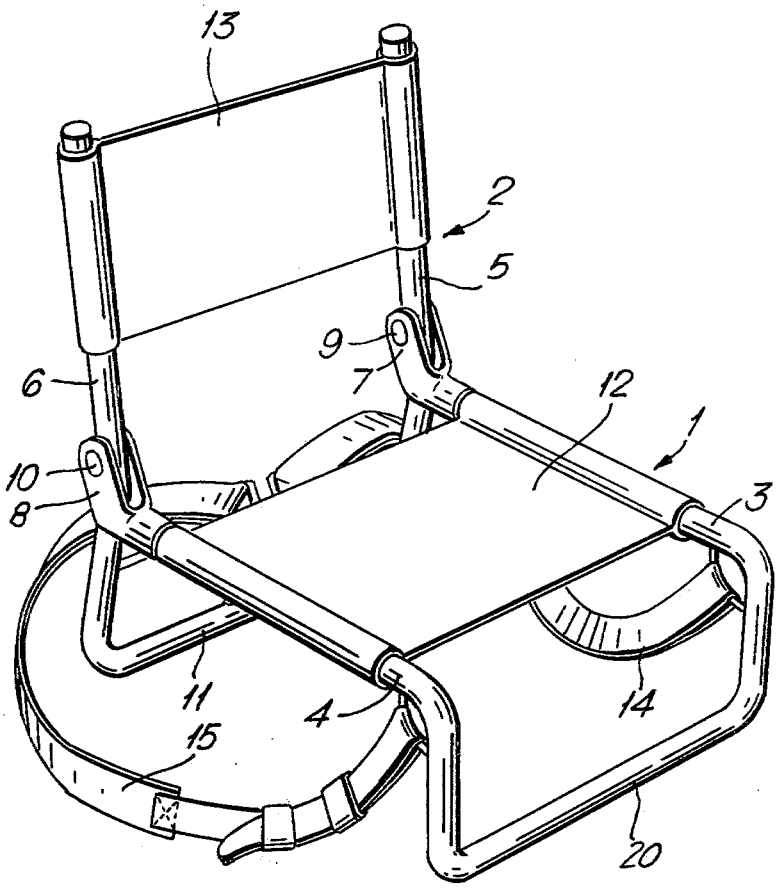
Figure 3:
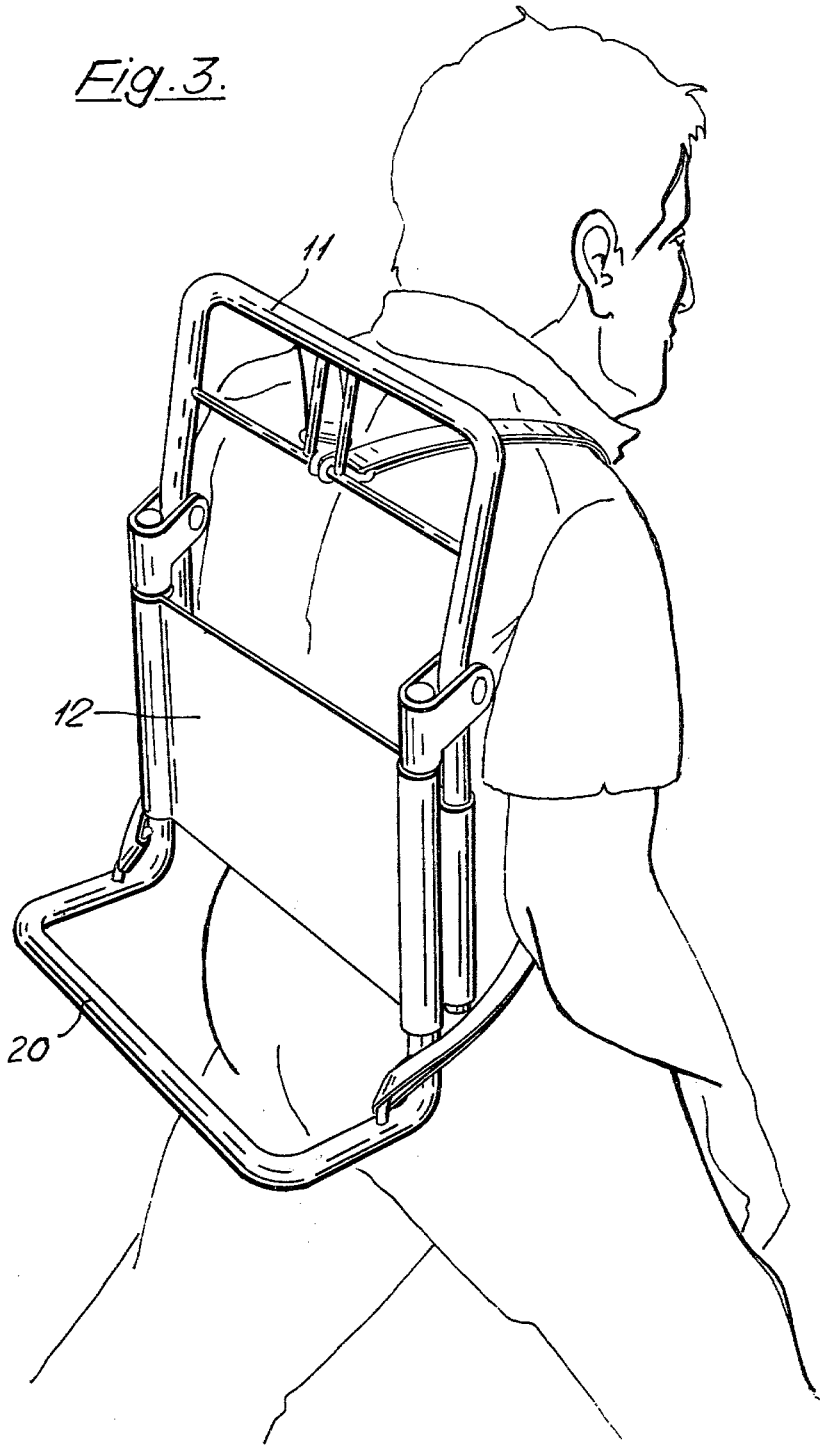

The invention will now be described more closely by way of an exemplary embodiment with reference to the accompanying drawings, wherein FIG. 1 shows a perspective view of an embodiment of the device in one functional position for use as a rucksack frame;

FIG. 2 shows a perspective view of the device in FIG. 1 in its other functional position for use as a chair; and FIG. 3 shows the rucksack frame of FIG. 1 as carried on the back of a person.

The device shown in the drawings comprises a first and a second frame member 1 and 2, respectively, of which each has mutually parallel side parts 3, 4 and 5, 6, repectively, and of which each in the illustrated embodiment consists of an essentially U-shaped stirrup which may advantageously be made of anodized aluminum tubes. The first frame member or stirrup 1 is at its free end portions by means of hinge connections pivotally connected with respective side parts 5, 6 of the second frame member at a distance from the ends of said parts.

In the illustrated embodiment the hinge connections consist of bifurcated or fork-shaped pivot pin holders 7 and 8, respectively, which holders are fixed in a suitable manner to the end portions of the side parts 3, 4 of the first frame member 1 and extend parallel to each other at an angle to the longitudinal axes of the side parts. These holders are hinged to the side parts 5, 6 of the second frame member 2 by means of pivot pins 9 and 10, respectively. The side parts of the two frame members can thereby be disposed parallel to each other as shown in FIG. 1, when the device is to be used as a rucksack frame, or be disposed at e.g. right angles to each other as shown in FIG. 2, when the device is to be used as a chair. In the latter position the side parts 5, 6 of the second frame member 2 may advantageously rest against respective ends of the side parts 3, 4 of the first frame member 1, so that further relative pivotal movement between the frame members is prevented and the second frame member provides a stable backrest.

At the end of the first frame member which is opposite to the hinge connections, said frame member is provided with a support portion which projects some distance outwards from the side parts 3, 4, and which in the illustrated embodiment is formed in that the legs of the U-shaped stirrup 1, at a distance from the web portion 20 of the stirrup, are bent at substantially right angles in a plane perpendicular to the pivot axis of the hinge connections. The projecting or protruding distance of said support portion essentially corresponds to the distance between each hinge connection and the outer end of an end support portion of the other frame member or stirrup 2, which end support portion is constituted by the web portion 11 of the second frame member 2 and the adjacent portions of the legs of the stirrup. In this way one achieves that the device, when it is used as a chair as shown in FIG. 2, gets equally, or substantially equally long supporting legs.

It will be evident that the support portion of the first stirrup 1 at the web portion 20 has a double function, as it provides for rucksack support when the device is used as a rucksack frame, and further constitutes the front legs of the chair when the device is used as a chair. Similarly, the end support portion with the web portion 11 of the second stirrup 2 has a double function as it provides for securing of the upper part of the rucksack in question (not shown) when the device is used as a rucksack frame, and further constitutes the rear legs of the chair when using the device as a chair. The rucksack (not shown) may e.g. be provided with a top portion which is formed as a pocket which may be threaded down over the top of the rucksack frame.

Each of the frame members 1, 2 is provided with supporting bands 12 and 13, respectively, which are stretched between the side parts of each frame member and may consist of a suitable textile material. As it will be understood, the supporting band 12 of the frame member 1 has as its main duty to act as seat cloth when the device is used as a chair, whereas the supporting band 13 of the other frame member 2 acts as back band when the device is used as a chair. The back band, which is the pressure surface which is received at the lower part of the back when using the device as a rucksack frame, has a relatively large width in order to give a comfortable distribution of the pressure caused by the weight of the sack.

At their support portions the frame members are further provided with holders or mountings for a pair of carrier straps 14 and 15 for use when the device is used as a rucksack frame. In the illustrated embodiment the end support portion of the second frame member 2 is for this purpose provided with a transversely extending rod 16 made of e.g. aluminum, which is provided in its central region with means for carrier strap attachment. The central region is here defined by a pair of stiffening bars 17 of which the ends are fixed, e.g. by welding, to the transverse rod 16 and to the web portion 11 of the stirrup 2. For attachment of the other ends of the carrier straps the first frame member is as shown provided with welded mounting hoops 18 and 19. It is however evident that other embodiments of mounting or attachment means than those shown in the drawings, may also be used.

When the described device is to be readjusted from rucksack frame to chair, the sack placed on the frame is released from the support portion of the first frame member 1, the sack e.g. being attached in a suitable manner to the attachment hoops 18 and 19 or the like, whereafter the sack with its pocket-shaped top portion is lifted from the top of the frame, i.e. the support portion of the second frame member. Thereafter e.g. the side parts 4 and 6 are gripped and the frame members are pivoted directly to the position shown in FIG. 2, so that a chair is formed thereby.

By means of the present invention there is provided a combination device of the aforementioned type with very few coinciding elements, more specifically only those portions of the side parts 3 and 5 respectively 4 and 6 which are lying alongside each other in FIG. 1, something which results in a minimum increase of weight.

What I claim is:

1. A device usable in a first functional position as a rucksack frame and usable in a second functional position as a chair with a backrest, the device comprising:

first and second tubular frame members, each frame member having an end support portion and parallel side parts secured to the end support portion and having respective end portions spaced from the associated end support portion;

hinge means having hinge connections for articulating said end portions of the side parts of the first frame member to respective side parts of the second frame member at locations intermediate the ends of said side parts of said second frame member, whereby the side parts of said first and said second frame members are capable of being disposed parallel to and at right angles to each other, respectively;

said end support portion of said first frame member projecting at an angle from its associated side parts by a distance essentially corresponding to the distance between said hinge connections and an outer edge of said end support portion of the second frame member; and the frame members being provided with supporting bands stretched between the side parts of each frame member in the regions between the hinge connections and the end portions of the side parts.

2. A device according to claim 1, wherein each frame member consists of an essentially U-shaped stirrup having a pair of legs and a web portion, the legs of said stirrups constituting said side parts of the frame members and the web portions of said stirrups constituting said support portions.

3. A device according to claim 2, wherein said end support portion of said first frame member is formed in that the legs of said stirrup, at a distance from said web portion, are bent at a substantially right angle in a plane perpendicular to the pivot axis of said hinge connections.

4. A device according to one of claims 2, 3 or 1, wherein said hinge connections comprise bifurcated pivot pin holders attached to respective end portions of the side parts of said first frame member and extending parallel to each other at an angle to the longitudinal axis of said side parts.

5. A device according to claim 1 wherein said end support portions of said frame members are provided with holders for a pair of carrier straps.

6. A device according to claim 5, wherein said end support portion of said second frame member is provided with a transversely extending rod which is provided at its central portion with means for carrier strap attachment.

7. A device according to claim 1, wherein said end support portions of said frame members in the first functional position of said device are positioned at opposite ends of the rucksack frame.

* * * * *